US007857419B2

(12) United States Patent
Chikamoto et al.

(10) Patent No.: US 7,857,419 B2
(45) Date of Patent: Dec. 28, 2010

(54) IMAGE RECORDING APPARATUS

(75) Inventors: Tadanobu Chikamoto, Nagoya (JP); Hiroshi Taira, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 329 days.

(21) Appl. No.: 12/181,213

(22) Filed: Jul. 28, 2008

(65) Prior Publication Data

US 2009/0027447 A1 Jan. 29, 2009

(30) Foreign Application Priority Data

Jul. 26, 2007 (JP) ..... 2007-194072

(51) Int. Cl.
*B41J 2/165* (2006.01)

(52) U.S. Cl. ..... 347/33

(58) Field of Classification Search ..... 347/33
See application file for complete search history.

(56) References Cited

U.S. PATENT DOCUMENTS

| | | | | |
|---|---|---|---|---|
| 2003/0081053 | A1* | 5/2003 | Barinaga et al. | 347/32 |
| 2003/0081055 | A1 | 5/2003 | Wotton et al. | |
| 2005/0093939 | A1 | 5/2005 | Takagi | |
| 2006/0274108 | A1 | 12/2006 | Shimizu | |
| 2007/0126817 | A1 | 6/2007 | Takagi | |
| 2008/0079773 | A1* | 4/2008 | Sakaida | 347/36 |
| 2009/0027445 | A1 | 1/2009 | Chikamoto | |
| 2009/0027446 | A1 | 1/2009 | Taira | |

FOREIGN PATENT DOCUMENTS

| | | | |
|---|---|---|---|
| EP | 1518689 | A1 | 3/2005 |
| JP | 2005132025 | A | 5/2005 |
| JP | 2009-028972 | A | 2/2009 |
| JP | 2009-028973 | A | 2/2009 |
| JP | 2009-028975 | A | 2/2009 |

OTHER PUBLICATIONS

European Patent Office, European Search Report for European Patent Application No. EP08013484.4 (counterpart to above-captioned patent application), dated Nov. 24, 2008.

* cited by examiner

*Primary Examiner*—Julian D Huffman
*Assistant Examiner*—Jason S Uhlenhake
(74) *Attorney, Agent, or Firm*—Baker Botts L.L.P.

(57) ABSTRACT

An image recording apparatus includes a plurality of liquid ejection heads, and a plurality of wipers. The plurality of liquid ejection heads are divided into a plurality of head groups each including two of the liquid ejection heads. When in a wiper withdrawal position, the wiper associated with one of the liquid ejection heads belonging to each head group is positioned so as to overlap the one liquid ejection head along a direction perpendicular to one direction and in addition overlap the other of the liquid ejection heads along the one direction, while the wiper associated with the other liquid ejection head is positioned so as to overlap the other liquid ejection head along the perpendicular direction and in addition overlap the one liquid ejection head along the one direction.

9 Claims, 8 Drawing Sheets

IMAGE RECORDING APPARATUS

CROSS REFERENCE to RELATED APPLICATION

The present application claims priority from Japanese Patent Application No. 2007-194072, which was filed on Jul. 26, 2007, the disclosure of which is herein incorporated by reference in its entirety.

BACKGROUND OF THE INVENTION

1. Field of the Invention

The present invention relates to an image recording apparatus having a liquid ejection head which ejects liquid.

2. Description of Related Art

Japanese Unexamined Patent Publication No. 2005-132025 discloses an ink-jet printer including four ink-jet heads and a maintenance unit. The four ink-jet heads are arranged side by side in a paper conveyance direction. The maintenance unit performs maintenance on the four ink-jet heads. In the ink-jet printer, the maintenance unit has a support member, a blade, a wipe roller, an ink absorber, and four caps. The support member is horizontally movable along a paper conveyance direction. The blade, the wipe roller, the ink absorber, and the four caps are mounted on the support member. When the maintenance unit is in a purge position, each cap covers a nozzle face and a purge operation is performed so that ink is ejected from nozzles toward the cap. Then, each cap gets separated from the nozzle face. While the maintenance unit is moving to a withdrawal position, the ink absorber, the wipe roller, and the blade sequentially get opposed to the nozzle faces so that ink is absorbed and wiped off by the respective members. In this way, maintenance is performed on the four ink-jet heads.

In the ink-jet printer disclosed in Japanese Unexamined Patent Publication No. 2005-132025 mentioned above, the withdrawal position of the maintenance unit is located downstream of the ink-jet heads in the paper conveyance direction, which increases a size of the ink-jet printer with respect to the paper conveyance direction.

SUMMARY OF THE INVENTION

An object of the present invention is to provide an image recording apparatus which can be downsized even if they have a plurality of liquid ejection heads.

According to an aspect of the present invention, there is provided an image recording apparatus comprising a plurality of liquid ejection heads, a recording medium conveyance mechanism, a plurality of wipers, and a movement mechanism. The plurality of liquid ejection heads respectively have ejection faces which are arranged in such a manner that the ejection faces form two rows extending in one direction and in addition two of the ejection faces included in different rows do not overlap each other along a direction perpendicular to the one direction with respect to an in-plane direction of the ejection faces. The plurality of liquid ejection heads are divided into a plurality of head groups each including two of the liquid ejection heads corresponding to the different rows. The recording medium conveyance mechanism conveys a recording medium in the one direction while making the recording medium opposed to the ejection faces. The plurality of wipers wipe the ejection faces of the liquid ejection heads. The movement mechanism moves two of the wipers for wiping two ejection faces of the two liquid ejection heads belonging to each head group, in opposite directions with respect to the perpendicular direction while keeping the two wipers in contact with the ejection faces. When in a wiper withdrawal position not opposed to the ejection face, the wiper associated with one of the liquid ejection heads belonging to each head group is positioned so as to overlap the one liquid ejection head along the perpendicular direction and in addition overlap the other of the liquid ejection heads along the one direction, while, when in the wiper withdrawal position, the wiper associated with the other liquid ejection head is positioned so as to overlap the other liquid ejection head along the perpendicular direction and in addition overlap the one liquid ejection head along the one direction.

In this aspect, ejection faces of the plurality of liquid ejection heads are arranged in two rows extending along one direction, in such a manner that two ejection faces belonging to different rows do not overlap each other along a direction perpendicular to the one direction. As a result, a free space appears in a region neighboring each liquid ejection head with respect to the perpendicular direction. A plurality of wipers associated with the respective liquid ejection heads are withdrawn into the space. Withdrawing the wipers into the free space in this way makes it unnecessary to provide another space which is special for the wipers to be positioned therein. Therefore, downsizing of the image recording apparatus can be realized.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Figure 1:
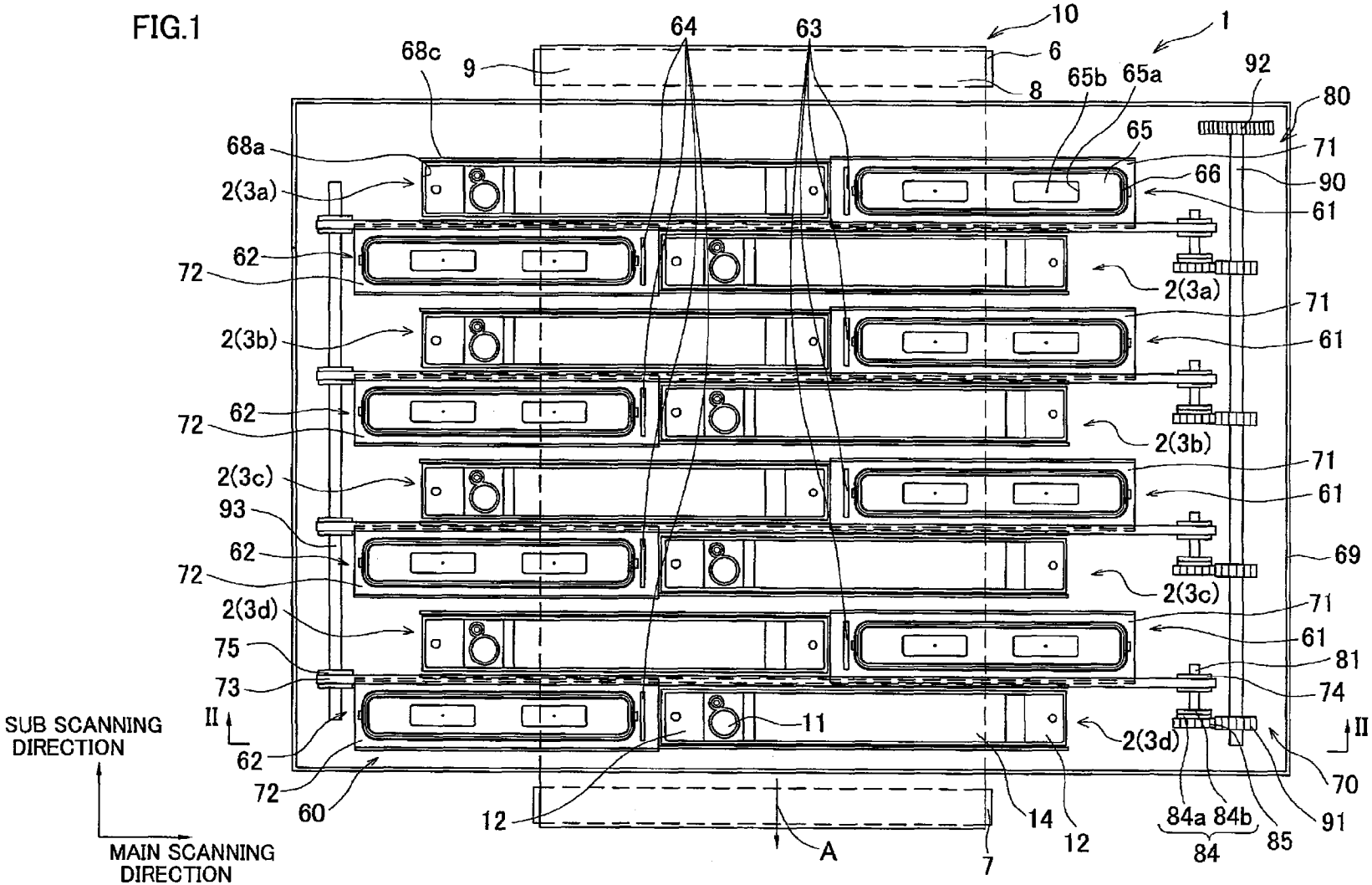
FIG. 1 is a plan view of an essential part of an ink-jet printer according to a first embodiment of the present invention.
Figure 2:
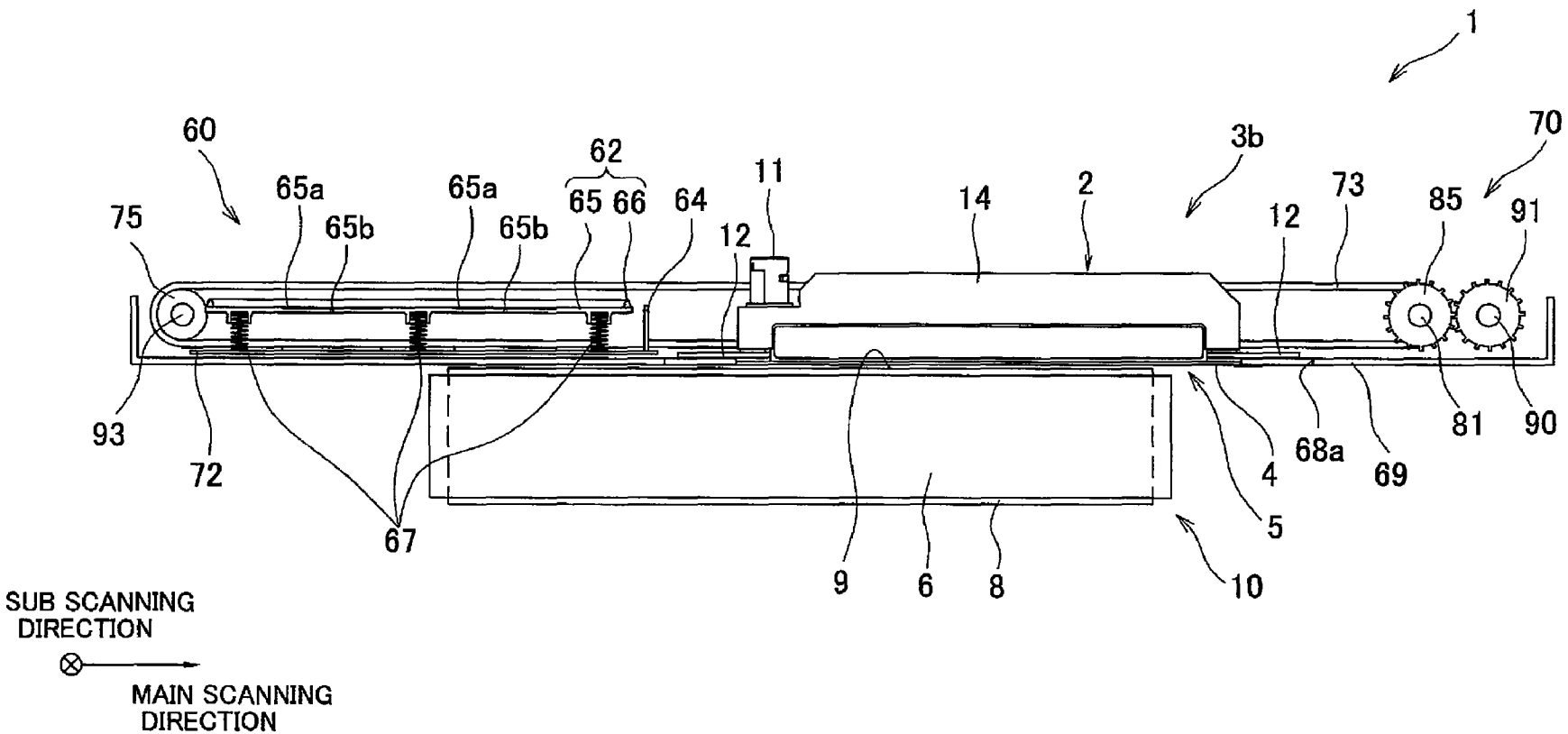
FIG. 2 is a sectional view as taken along line II-II illustrated in FIG. 1.
Figure 3:
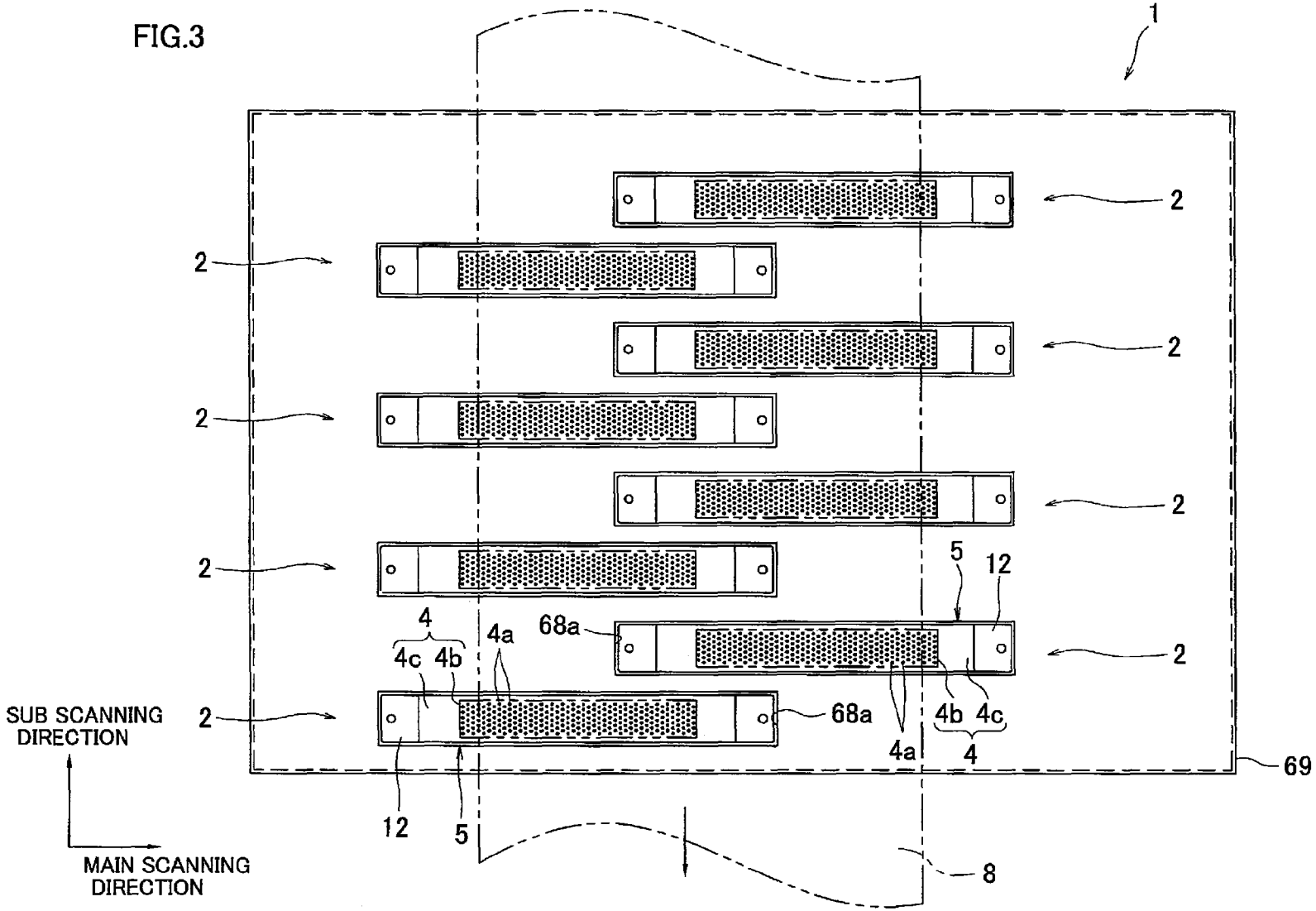
FIG. 3 shows four head groups illustrated in FIG. 1, as seen from a bottom side thereof.

FIG. 1 is a plan view of an essential part of an ink-jet printer according to a first embodiment of the present invention. FIG. 2 is a sectional view as taken along line II-II illustrated in FIG. 1. FIG. 3 shows four head groups illustrated in FIG. 1, as seen from a bottom side thereof.

As shown in FIG. 1, an ink-jet printer 1, which is an image recording apparatus according to a first embodiment of the present invention, is a color ink-jet printer of line type including four head groups 3*a*, 3*b*, 3*c*, and 3*d* each of which is made up of two ink-jet heads 2 or liquid ejection heads. The ink-jet printer 1 has a paper feed unit (not shown) and a paper discharge unit (not shown) at upper and lower parts of FIG. 1, respectively.

In the ink-jet printer 1, a paper conveyance mechanism 10 which is a recording medium conveyance mechanism is provided between the paper feed unit and the paper discharge unit, at a position opposed to the four head groups 3*a*, 3*b*, 3*c*, and 3*d*. The paper conveyance mechanism 10 conveys a paper as a recording medium to a position opposed to ink ejection faces 4 which are ejection faces of the eight ink-jet heads 2. As shown in FIG. 1, the paper conveyance mechanism 10 has a pair of belt rollers 6 and 7 which are disposed so as to sandwich the four head groups 3*a*, 3*b*, 3*c*, and 3*d* with respect to the sub scanning direction (i.e., an up-and-down direction in FIG. 1), and an endless conveyor belt 8 which is wound on the pair of belt rollers 6 and 7 to be stretched therebetween. A conveyor motor 97 (see FIG. 4) applies driving force to the belt roller 7 which is thereby rotated in a predetermined direction. As the belt roller 7 rotates in the predetermined direction, the conveyor belt 8 travels so as to convey the paper in a paper conveyance direction A (i.e., in a direction from up to down in FIG. 1).

The conveyor belt 8 has a two-layer structure made up of a base material and urethane rubber. An outer surface of the conveyor belt 8, that is, a conveyor face 9 has adhesiveness. A paper fed out from the paper feed unit is maintained due to the adhesiveness of the conveyor face 9, and in this condition conveyed in the conveyance direction A.

Each ink-jet head 2 has a rectangular parallelepiped shape elongated in a main scanning direction (which is a direction perpendicular to the paper conveyance direction A: a perpendicular direction), as shown in FIGS. 1 and 2. Each ink-jet head 2 has a head main body 5 at its lower end.

A reservoir unit which temporarily stores ink therein is fixed to an upper face of the head main body 5. The reservoir unit is partially covered with a cover 14. Referring to FIG. 1, a tube joint 11 is connected to a left end of the reservoir unit. Ink supplied through the tube joint 11 is stored in an ink reservoir which is formed within the reservoir unit. The reservoir unit is longer than the head main body 5 with respect to the main scanning direction. Portions 12 of the reservoir unit extend out on both sides of the reservoir unit with respect to the main scanning direction. The portions 12 serve as a fixing portion to be fixed to an elevation frame (not shown) which is provided for every reservoir unit. Each ink-jet head 2 is fixed to the elevation frame via the fixing portion. The elevation frame can be moved up and down by a head elevation mechanism 98 (see FIG. 4).

Normally, the eight ink-jet heads 2 are disposed in a printing position (i.e., a position of the ink-jet head 2 shown in FIG. 2). When the ink-jet heads 2 are in the printing position, each ink ejection face 4 and the conveyor face 9 of the conveyor belt 8 extend in parallel with each other and at a predetermined interval therebetween. With this structure, while a paper conveyed by the conveyor belt 8 is passing immediately below the eight head main bodies 5 sequentially, a desired image is formed on the paper. For a maintenance operation on the ink-jet head 2, on the other hand, the head elevation mechanism 98 moves up the elevation frame to which an ink-jet head 2 to be subjected to the maintenance operation is fixed. This brings the ink-jet head 2 fixed to this elevation frame into a head maintenance position (see FIG. 5A) which is above and away from the printing position. During the maintenance operation, only the ink-jet head 2 to be subjected to the maintenance operation may be disposed in the maintenance position or alternatively all of the eight ink-jet heads 2 may be disposed in the maintenance position.

As shown in FIG. 3, small-diameter nozzles 4*a* which eject ink, an ink ejection region 4*b* which is formed by a collection of the nozzles 4*a*, and an outside region 4*c* which surrounds the ink ejection region 4*b* are provided on a bottom face of the head main body 5, that is, on the ink ejection face 4 of the ink-jet head 2.

As shown in FIGS. 1 and 3, the eight ink-jet heads 2 are arranged in a zigzag pattern in such a manner that the ink ejection faces 4 form two rows each including four ink ejection faces 4 which are arranged side by side along the sub scanning direction and in addition the ink ejection faces 4 included in different rows do not overlap each other with respect to the main scanning direction. The eight ink-jet heads 2 are divided into four head groups 3*a*, 3*b*, 3*c*, and 3*d* each of which includes two ink-jet heads 2. Ink ejection faces 4 of the two ink-jet heads 2 neighbor each other with respect to the sub scanning direction and belong to different rows. The four head groups 3*a*, 3*b*, 3*c*, and 3*d* are arranged side by side along the sub scanning direction, so as to arrange the eight ink-jet heads 2 in a zigzag pattern with respect to the sub scanning direction.

Two ink-jet heads 2 included in each of the head groups 3*a*, 3*b*, 3*c*, and 3*d* have their ink ejection faces 4 overlap each other in the sub scanning direction, so that print regions (i.e., ink ejection regions 4*b*) for making printing on a paper continue in the main scanning direction. More specifically, two ink-jet heads 2 included in the same head group are arranged in such a manner that an interval in the main scanning direction between neighboring nozzles 4*a* in an ink ejection region 4*b* of one ink-jet head 2 is the same as an interval in the main scanning direction between an innermost (i.e., leftmost in FIG. 3) one of the nozzles 4*a* formed in the ink ejection face 4 of the right-side ink-jet head 2 in FIG. 3 which is included in the head group 3*a* and an innermost (i.e., rightmost in FIG. 3) one of the nozzles 4*a* formed in the ink ejection face 4 of the left-side ink-jet head 2 in FIG. 3 which is included in the head group 3*a*. Each of the other head groups 3*b*, 3*c*, and 3*d* includes two ink-jet heads 2 arranged in the same manner as in the head group 3*a*. The eight ink-jet heads 2 eject ink of four different colors (magenta, yellow, cyan, and black), each color corresponds to each of the head groups 3*a*, 3*b*, 3*c*, and 3*d*. That is, two ink-jet heads 2 belonging to the same head group, neighboring each other in the sub scanning direction, and included in different rows eject ink of the same color.

Next, a maintenance unit 60 which performs maintenance on the ink-jet heads 2 will be described. As shown in FIGS. 1 and 2, the maintenance unit 60 has four caps 61 and four wipers 63, four caps 62 and four wipers 64, a movement mechanism 70, and a tray 69. The four caps 61 and four wipers 63 are associated with four ink-jet heads 2 which belong to the respective head groups 3*a*, 3*b*, 3*c*, and 3*d* arranged side by side along the sub scanning direction and are included in one (left one in FIG. 1) of the rows. The four caps 62 and four wipers 64 are associated with four ink-jet heads 2 which belong to the respective head groups 3*a*, 3*b*, 3*c*, and 3*d* arranged side by side along the sub scanning direction and are included in one (right one in FIG. 1) of the rows. The movement mechanism 70 moves, on a head group basis, the eight caps 61 and 62 and the eight wipers 63 and 64 in the main scanning direction. The tray 69 contains therein the eight caps 61 and 62, the eight wipers 63 and 64, and the movement mechanism 70. The tray 69 has a pass through 68*a* which extends through the tray 69 in a vertical direction. The pass through 68*a* is at a position opposed to each ink-jet head 2. The pass through 68*a* has a rectangular shape in a plan view, and has such a size that each of the eight ink ejection faces 4 of the respective ink-jet heads 2 can entirely be opposed to the conveyor face 9.

The caps 61 and 62 have the same shape and the same size, and each of them is made up of a base material 65 and an annular protrusion 66. A shape of the base material 65 is similar to but slightly larger than the ink ejection region 4*b*. The annular protrusion 66 stands at a periphery of the base material 65. This structure allows the caps 61 and 62 to cover the ink ejection regions 4*b* with distal ends of the annular protrusions 66 being in contact with the outside regions 4*c* of the ink ejection faces 4. Thereby, drying of ink existing within the nozzles 4*a* can be suppressed.

Two recesses 65*a* which open upward in the vertical direction are formed in the base material 65. The two recesses 65*a* are disposed side by side along the main scanning direction. A through hole 65*b* is formed at a bottom of the recess 65*a*. Since the through holes 65*b* are formed, ink ejected into the caps 61, 62 in a purge operation and collected within the recess 65*a* can be discarded through the through holes 65*b* into a not-shown waste ink reservoir.

As shown in FIG. 2, each of the caps 61, 62 is supported from below by three springs 67. Since each of the caps 61, 62 is supported by the three springs 67, impact caused when the annular protrusion 66 comes into contact with the ink ejection face 4 can be softened, so that the ink ejection face 4 is not easily damaged by the annular protrusion 66.

The maintenance unit 60 also has a cap level adjusting mechanism 99 (see FIG. 4) which moves down the caps 61, 62 when the wipers 63, 64 wipe the ink ejection faces 4. As the cap level adjusting mechanism 99 moves down the caps 61, 62, distal ends of the wipers 63, 64 come higher than the caps 61, 62, and the caps 61, 62 no longer come into contact with the ink ejection faces 4.

As shown in FIG. 1, each of the wipers 63, 64 is disposed between a corresponding ink-jet head 2 and a cap 61, 62 associated with this ink-jet head 2. A length of extension of the wiper 63, 64 is substantially equal to a width of the ink ejection face 4 of the corresponding ink-jet head 2 with respect to the sub scanning direction. The wipers 63, 64 are made of an elastic material such as rubber. The wipers 63, 64 stand on later-described support plates 71, 72 which support the caps 61, 62 via the springs 67. In a case where the caps 61, 62 are not moved down by the cap level adjusting mechanism 99, the distal ends of the wipers 63, 64 are substantially at the same level as the base materials of the caps 61, 62.

When disposed in a withdrawal position not opposed to the ink ejection face 4 (as shown in FIG. 1), the wiper 63 for the head group 3*a* locates in a position overlapping the corresponding left-side ink-jet head 2 in FIG. 1 in the main scanning direction and overlapping the right-side ink-jet head 2 in FIG. 1 in the sub scanning direction. When disposed in a withdrawal position not opposed to the ink ejection face 4 (as shown in FIG. 1), the wiper 64 for the head group 3*a* locates in a position overlapping the corresponding right-side ink-jet head 2 in FIG. 1 in the main scanning direction and overlapping the left-side ink-jet head 2 in FIG. 1 in the sub scanning direction. The wipers 63, 64 for the head groups 3*b*, 3*c*, and 3*d* are positioned in the same manner as the wipers 63, 64 for the head group 3*a* are. The withdrawal position is equivalent to a wiper withdrawal position and a cap withdrawal position of the present invention.

As shown in FIGS. 1 and 2, the movement mechanism 70 has two shafts 90 and 93, four shafts 81, four belt rollers 74, four belt rollers 75, four belts 73, eight support plates 71 and 72, and a power transmission mechanism 80. The two shafts 90 and 93, and the four shafts 81 extend in the sub scanning direction, and are supported rotatably about an axis thereof. The four belt rollers 74 are provided for the four shafts 81, respectively. The four belt rollers 75 are provided on the shaft 93. Each of the four belts 73 spans the belt rollers 74 and 75. The eight support plates 71 and 72 are coupled with the four belts 73, respectively. The power transmission mechanism 80 transmits rotational power to each belt roller 74.

The four support plates 71 support the caps 61 and wipers 63 associated with, among the ink-jet heads of the head groups 3*a*, 3*b*, 3*c*, and 3*d*, the ink-jet heads 2 included in one (left one in FIG. 1) of the rows extending in the sub scanning direction. The four support plates 71 are coupled with portions of the belts 73 extending in the main scanning direction. The cap 61 and the wiper 63 are positioned in such a manner that, in a plan view, they overlap the corresponding ink-jet head 2 in the main scanning direction and also overlap the other ink-jet head 2 belonging to the same head group as the corresponding ink-jet head 2 in the sub scanning direction.

The four support plates 72 support the caps 62 and wipers 64 associated with, among the ink-jet heads of the head groups 3*a*, 3*b*, 3*c*, and 3*d*, the ink-jet heads 2 included in the other (right one in FIG. 1) of the rows extending in the sub scanning direction. The four support plates 72 are coupled with portions of the belts 73 extending in the main scanning direction. The cap 62 and the wiper 64 are positioned in such a manner that, in a plan view, they overlap the corresponding ink-jet head 2 in the main scanning direction and also overlap the other ink-jet head 2 belonging to the same head group as the corresponding ink-jet head 2 in the sub scanning direction.

In other words, with respect to the sub scanning direction, the eight support plates 71 and 72 are arranged in a zigzag pattern inverse to the zigzag arrangement pattern of the eight ink-jet heads 2.

The four belt rollers 75 are mounted on the shaft 93, at positions overlapping the respective head groups 3*a*, 3*b*, 3*c*, and 3*d* with respect to the main scanning direction, with their diameters extending in the vertical direction. The four belt rollers 75 are supported rotatably in clockwise and counterclockwise directions in FIG. 2.

The four belt rollers 74 are mounted on the four shafts 81, at positions overlapping the respective head groups 3*a*, 3*b*, 3*c*, and 3*d* with respect to the main scanning direction, with their diameters extending in the vertical direction. The four belt rollers 74 are fixed rotatably in clockwise and counterclockwise directions in FIG. 2.

Each of the four belts 73 is wound on a pair of belt rollers 74 and 75 to be stretched between them and, with respect to the sub scanning direction, positioned between two of the ink-jet heads 2 belonging to the head groups 3*a*, 3*b*, 3*c*, and 3*d*. Portions of the belt 73 extending in the main scanning direction are opposed to each other with respect to the vertical direction. The belt 73 of this embodiment is a rubber-made flat belt having a very narrow width. However, a rubber belt having a circular section, or a metal-made wire may be adopted for the belt 73. In short, any member may be adopted as long as it functions as a belt.

The power transmission mechanism 80 has a gear 92, four gears 91, four gears 85, and clutches 84. The gear 92 is fixed to one end (upper end in FIG. 1) of the shaft 90 so as to be rotatable with the shaft 90 about an axis of the shaft 90. The four gears 91 are fixed to the shaft 90 at positions along the sub scanning direction which correspond to the respective heads 3*a*, 3*b*, 3*c*, and 3*d*. The four gears 91 are rotatable with the shaft 90 about the axis of the shaft 90. The four gears 85 are engaged with the four gears 91 to thereby rotate with the four gears 91. The clutches 84 are four switching means each disposed between each of the four gears 85 and each of the four shafts 81.

The clutch 84 has an input shaft 84*a* fixed to the gears 85, and an output shaft 84*b* fixed to the shafts 81. The clutch 84 has such a structure that the input shaft 84*a* and the output shaft 84*b* are electromagnetically coupled with each other so that power is transmitted from the input shaft 84*a* to the output shaft 84*b*. Therefore, as the input shaft 84*a* rotates, the output shaft 84*b* rotates accordingly. When the input shaft 84*a* and the output shaft 84*b* are decoupled, power is no longer transmitted from the input shaft 84*a* to the output shaft 84*b*. Therefore, even when the input shaft 84*a* rotates, the output shaft 84*b* does not rotate.

As a rotation motor 95 (see FIG. 4) is driven to rotate the gear 92 in a predetermined direction thereby also rotate the shaft 90 in the same direction, rotational power traveling in a reverse direction is transmitted via the four gears 91 and 85 to the input shafts 84*a* of the clutches 84. At this time, when the input shaft 84*a* and the output shaft 84*b* are electromagnetically coupled with each other, rotation of the input shaft 84*a* in the reverse direction is transmitted to the output shaft 84*b*. Thereby, the shaft 81 and the belt roller 74, together with the output shaft 84*b*, rotate in the reverse direction. Consequently, the belt 73 rotates in the direction reverse to the rotation direction of the gear 92. That is, the belt 73 corresponding to each of the head groups 3*a*, 3*b*, 3*c*, and 3*d* can be selectively run, by switching a state of the clutch 84 between a state where the input shaft 84*a* and the output shaft 84*b* corresponding to each of the head groups 3*a*, 3*b*, 3*c*, and 3*d* are electromagnetically coupled with each other and a state where they are not electromagnetically coupled with each other.

The support plate 71 is coupled with vertically-upper one of the portions of the belt 73 extending in the main scanning direction. The support plate 72 is coupled with vertically-lower one of the portions of the belt 73 extending in the main scanning direction. As shown in FIG. 1, eight sets of two guide rails 68*c* extending in the main scanning direction are formed on the tray 69. Each of the eight sets corresponds to each pass through 68*a*. The pass through 68*a* is sandwiched between the corresponding two guide rails 68*c* with respect to the sub scanning direction. Among the eight sets of guide rails 68*c*, four sets which form left one of rows in FIG. 1 arranged side by side along the sub scanning direction are partially opposed to both ends of the support plates 71 with respect to the sub scanning direction. The four sets of guide rails 68*c* are fitted with recesses which extend in the main scanning direction and are formed at the both ends of the support plates 71 with respect to the sub scanning direction. Thereby, the four sets of guide rails 68*c* are slidable along the recesses. The other four sets of guide rails 68*c* which form right one of the rows in FIG. 1 arranged side by side along the sub scanning direction are partially opposed to both ends of the support plates 72 with respect to the sub scanning direction. The four sets of guide rails 68*c* are fitted with recesses which extend in the main scanning direction and are formed at the both ends of the support plates 72 with respect to the sub scanning direction. Thereby, the four sets of guide rails 68*c* are slidable along the recesses.

In the maintenance unit 60 having the above-described structure, when the rotation motor 95 rotates the gear 92 in the clockwise direction in FIG. 2, the cap 61 and the wiper 63 mounted on the support plate 71 and associated with the head group for which the clutch 84 is electromagnetically coupled are moved together with the support plate 71, leftward in FIG. 1 from the withdrawal position (as shown in FIG. 1) which is not opposed to the corresponding ink ejection face 4. In addition, the cap 62 and the wiper 64 mounted on the support plate 72 and associated with the head group for which the clutch 84 is electromagnetically coupled are moved together with the support plate 72, rightward in FIG. 1 from the withdrawal position which is not opposed to the corresponding ink ejection face 4. In this way, the two caps 61, 62 and the two wipers 63, 64 associated with the head group for which the clutch 84 is electromagnetically coupled can be selectively moved to capping positions which are opposed to the corresponding ink ejection faces 4. That is, the eight caps 61, 62 and the eight wipers 63, 64 associated with all of the four head groups 3*a*, 3*b*, 3*c*, and 3*d* can be moved to positions opposed to the respective ink ejection faces 4, by electromagnetically coupling all of the four clutches 84.

On the other hand, when the rotation motor 95 rotates the gear 92 in the counterclockwise direction in FIG. 2, the cap 61 and the wiper 63 mounted on the support plate 71 and associated with the head group for which the clutch 84 is electromagnetically coupled are moved rightward in FIG. 1 from the position opposed to the corresponding ink ejection face 4. In addition, the cap 62 and the wiper 64 mounted on the support plate 72 and associated with the head group for which the clutch 84 is electromagnetically coupled are moved leftward in FIG. 1 from the position opposed to the corresponding ink ejection face 4. In this way, the caps 61, 62 and the wipers 63, 64 associated with the head group for which the clutch 84 is electromagnetically coupled can be moved to the withdrawal positions which are not opposed to the corresponding ink ejection faces 4. That is, the eight caps 61, 62 and the eight wipers 63, 64 associated with all of the four head groups 3*a*, 3*b*, 3*c*, and 3*d* can be moved to the withdrawal positions not opposed to the respective ink ejection faces 4, by electromagnetically coupling all of the four clutches 84.

Figure 4:
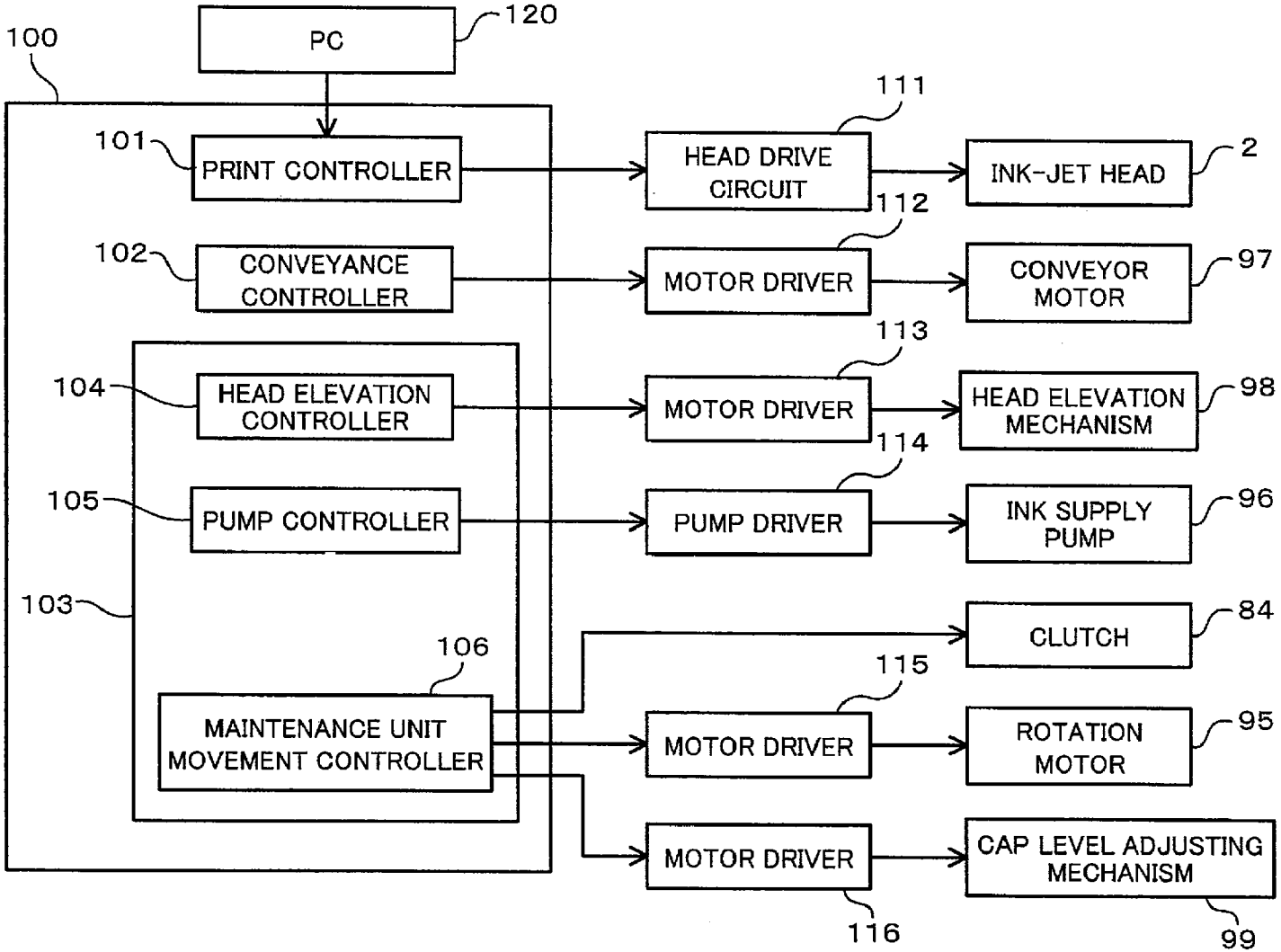
FIG. 4 is a block diagram schematically showing a controller.

Next, a controller 100 which controls an operation of the ink-jet printer 1 will be described with reference to FIG. 4. FIG. 4 is a block diagram schematically showing a controller. The controller 100 is made up of a CPU (Central Processing Unit), a ROM (Read Only Memory), a RAM (Random Access Memory), and the like, which work as a print controller 101, a conveyance controller 102, and a maintenance controller 103 as shown in FIG. 4.

When the controller 100 receives print data from an external device such as a PC (personal computer) 120, the print controller 101 controls a head drive circuit 111 to eject ink from the corresponding ink-jet head 2.

When the controller 100 receives print data from an external device such as the PC 120, the conveyance controller 102 controls a motor driver 112 so as to drive a conveyor motor 97 thereby conveying a paper on the conveyor belt 8.

The maintenance controller 103 has a head elevation controller 104, a pump controller 105, and a maintenance unit movement controller 106 which is a movement control unit.

The head elevation controller 104 controls the head elevation mechanism 98 in accordance with a maintenance operation, to move up and down the ink-jet head 2 together with the elevation frame.

When a purge is needed, such as when ink is initially introduced into the ink-jet heads 2 or when printing is started after a rest condition where a printing operation is kept unperformed for a long time, the pump controller 105 controls a pump driver 114 so as to drive an ink supply pump 96 to forcibly feed ink into the ink-jet heads 2.

The maintenance unit movement controller 106 controls a motor driver 115 to thereby drive the rotation motor 95, so as to make the belt 73 travel in a predetermined direction in accordance with a maintenance operation so that the caps 61, 62 and the wipers 63, 64 move together with the support plates 71, 72. The maintenance controller 106 also controls the clutch 84 corresponding to the head group 3*a*, 3*b*, 3*c*, or 3*d* to be subjected to a maintenance operation. Further, the maintenance unit movement controller 106 controls a motor driver 116 in such a manner that the cap level adjusting mechanism 99 moves down the caps 61, 62 to a lower level, in order that the wipers 63, 64 can wipe the ink ejection faces 4. Like this, the maintenance unit movement controller 106 is able to switch only one clutch 84 so as to transmit power from the rotation motor 95 to the belt 73. Therefore, only the ink ejection faces 4 in one head group can be wiped by the wipers 63, 64. Here, the maintenance unit movement controller 106 may not selectively cause electromagnetic coupling in the clutch 84 for each of the head groups 3*a*, 3*b*, 3*c*, and 3*d*, but instead may cause electromagnetic coupling in all of the four clutches 84. This can shorten a time required for wiping all the ink ejection faces 4 by the wipers 63, 64.

Figures 5A, 5B, 5C:
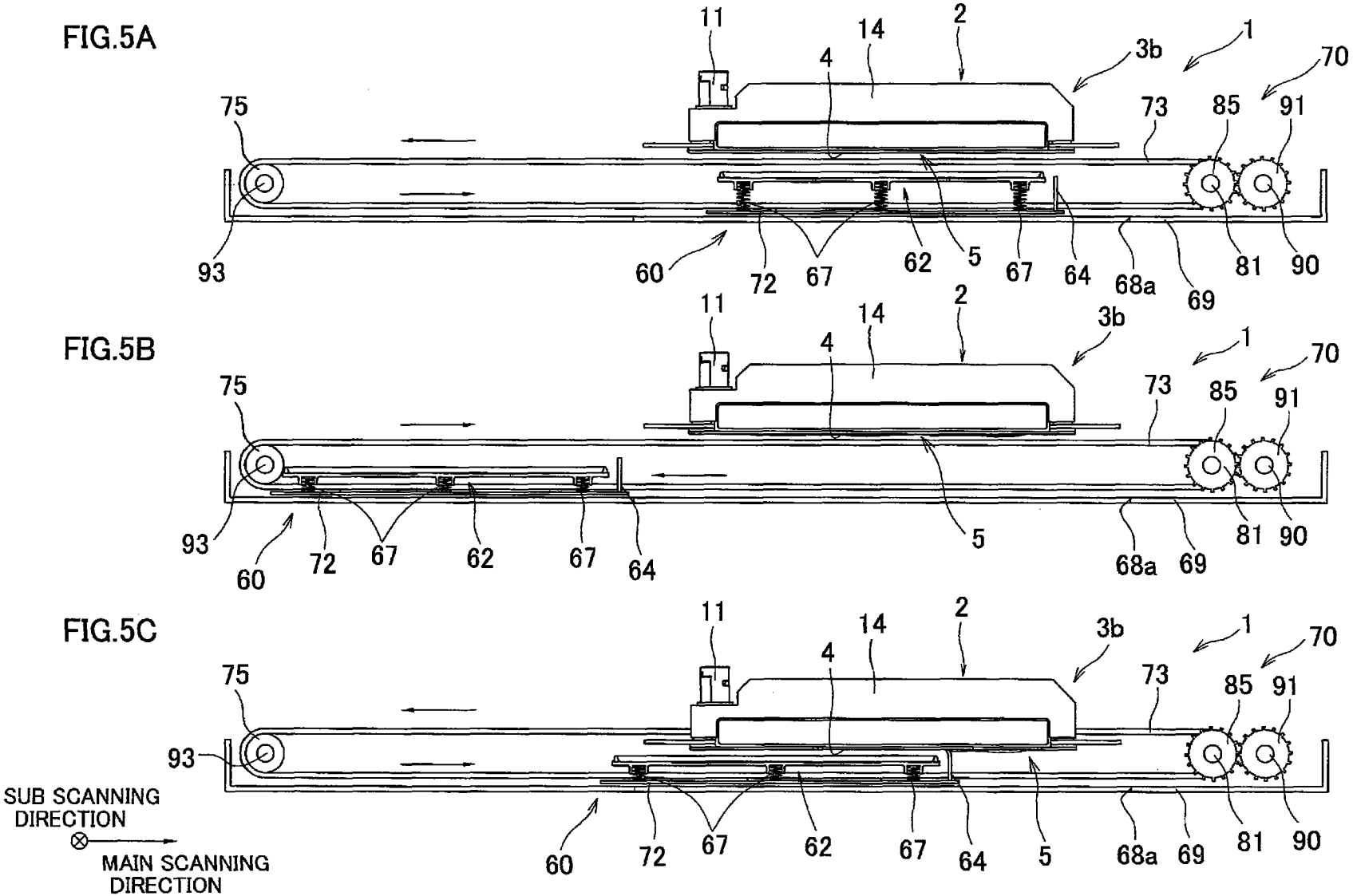
FIGS. 5A, 5B, and 5C show, over time, a purge operation on ink-jet heads and a wiping operation on ink ejection faces.
Figures 6A, 6B, 6C:
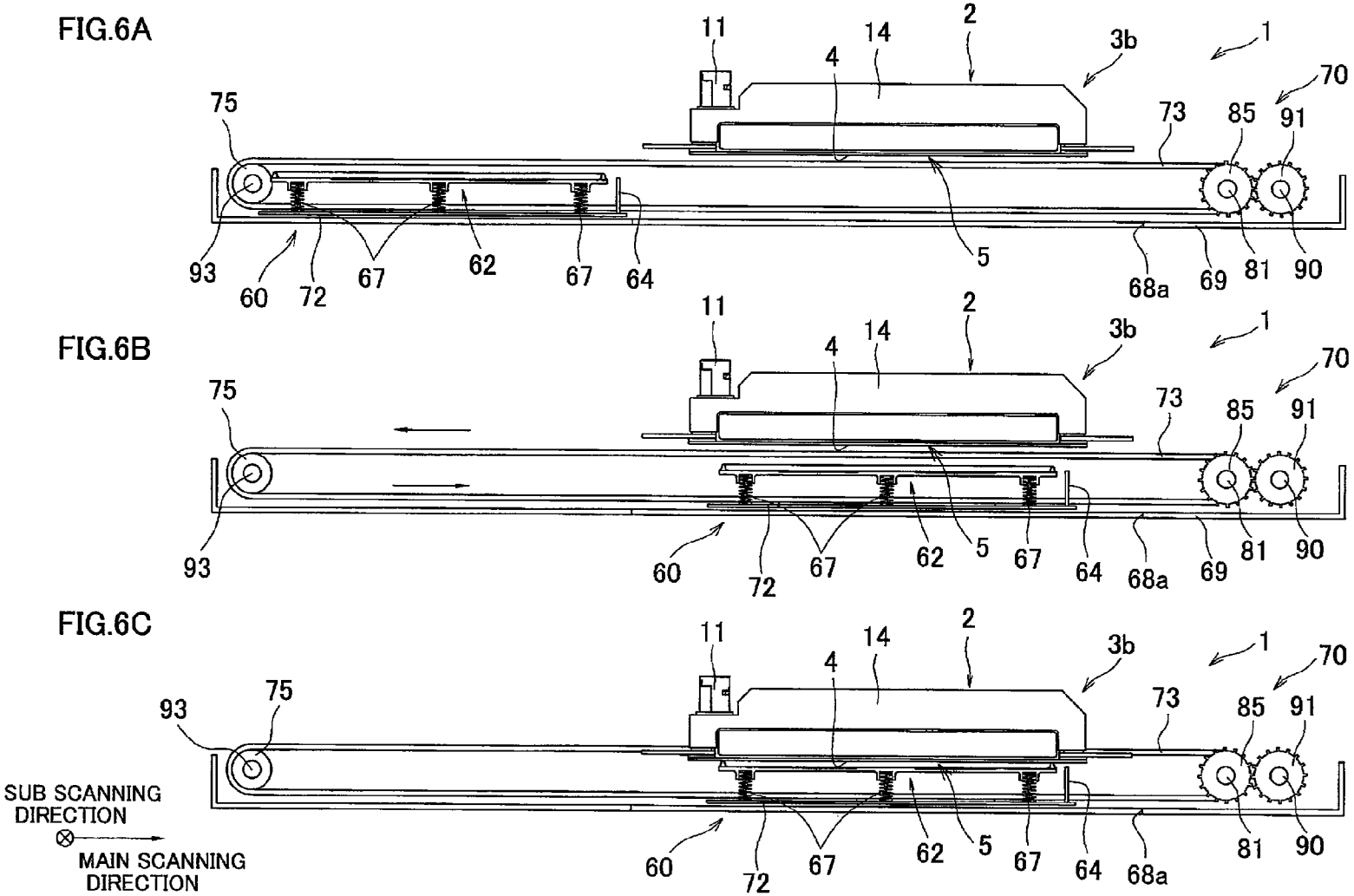
FIGS. 6A, 6B, and 6C show, over time, a capping operation for covering the ink ejection faces with caps.

Next, a maintenance operation performed by the maintenance unit 60 will be described with reference to FIGS. 5A to 5C and FIGS. 6A to 6C. FIGS. 5A, 5B, and 5C show, over time, a purge operation on ink-jet heads and a wiping operation on ink ejection faces. FIGS. 6A, 6B, and 6C show, over time, a capping operation for covering the ink ejection faces with caps.

For performing a purge operation in order to restore the ink-jet head 2 which is showing ejection failure or the like, the head elevation controller 104 controls the head elevation mechanism 98 so that the ink-jet head 2 targeted for the purge operation and the ink-jet head 2 grouped with the targeted ink-jet head 2 are moved up from the printing position to the head maintenance position, as shown in FIG. 5A. Then, electromagnetic coupling is caused in the clutch 84 which corresponds to the head group including the ink-jet head 2 targeted for the purge operation, so that the caps 61, 62 associated with the ink-jet head 2 targeted for the purge operation and the ink-jet head 2 grouped with the targeted ink-jet head 2 are moved from the cap withdrawal position to the capping position. Then, the maintenance unit movement controller 106 rotates the rotation motor 95 so as to rotate the gear 92 in the clockwise direction in FIG. 5A and thereby rotate the belt roller 74 in the counterclockwise direction in FIG. 5A, so that the portions of the belt 73 extending in the main scanning direction travel in the main scanning direction. At this time, the cap 61 moves leftward in FIG. 1 along the main scanning direction, and the cap 62 moves rightward in FIG. 1 (rightward in FIG. 5A) along the main scanning direction. In other words, the cap 61 and the cap 62 move in opposite directions with respect to the main scanning direction. At this time, the wipers 63, 64 mounted on the same support plates 71, 72 also move together with the caps 61, 62, respectively.

Then, the pump controller 105 supplies ink from a supply pump 96 to the ink-jet heads 2, to thereby perform a purge operation for ejecting ink from the nozzles 4*a* of the ink-jet heads 2 toward the caps 61, 62. After ink is purged into the caps 61, 62, the maintenance unit movement controller 106 rotates the rotation motor 95 in the reverse direction so as to rotate the gear 92 in the counterclockwise direction in FIG. 5A and thereby rotate the belt roller 74 in the clockwise direction in FIG. 5A, so that the portions of the belt 73 extending in the main scanning direction travel in the main scanning direction, in order that the caps 61, 62 move from the capping position to the cap withdrawal position. At this time, the cap 61 moves rightward in FIG. 1 along the main scanning direction, and the cap 62 moves leftward in FIG. 1 (leftward in FIG. 5A) along the main scanning direction. Then, the motor driver 116 controls the cap level adjusting mechanism 99 to move down the caps 61, 62, as shown in FIG. 5B. At this time, the caps 61, 62 are moved down to such a degree that the distal ends (upper ends) of the wipers 63, 64 come higher than upper ends of the caps 61, 62 are.

Then, the head elevation controller 104 controls the head elevation mechanism 98 to move down the ink-jet head 2 which has been moved up, to such a degree that the ink ejection faces 4 come slightly lower than the distal ends of the wipers 63, 64 and higher than the upper ends of the caps 61, 62, as shown in FIG. 5C. Then, the maintenance unit movement controller 106 rotates the rotation motor 95 so as to rotate the gear 92 in the clockwise direction in FIG. 5C and thereby rotate the belt roller 74 in the counterclockwise direction in FIG. 5C, so that the portions of the belt 73 extending in the main scanning direction travel in the main scanning direction, in order that the wipers 63, 64 move from the wiper withdrawal position to a position which allows the caps 61, 62 to reach the capping position. At this time, the distal ends of the wipers 63, 64, which locate higher than the ink ejection faces 4, come into contact with the ink ejection faces 4 while bending, so that ink adhering to the ink ejection faces 4 as a result of the purge is wiped off. At this time, in addition, the wiper 63, 64 moves from an inner end of the ink ejection face 4 to be wiped (one end of the outside region 4*c*) toward an outer end thereof with respect to the main scanning direction. At a position where the wiper 63, 64 reaches the outer end of the ink ejection face 4 (the other end of the outside region 4*c*), the wiper 63, 64 stops its wiping operation.

Then, the head elevation controller 104 controls the head elevation mechanism 98 to move up the ink-jet heads 2 so as to separate the wipers 63, 64 from the ink ejection faces 4. Then, the wipers 63, 64 are moved to the wiper withdrawal position. In this way, the maintenance operation is completed in which the ink-jet head 2 showing ink ejection failure is restored by the purge and ink adhering to the ink ejection face 4 as a result of the purge is wiped off.

In the following, a description will be given to a capping operation for covering the ink ejection face 4 with the cap 61, 62 during a rest time in which the printer 1 does not perform printing on a paper or the like for a long time. In this case as well as in the above-described case, the head elevation controller 104 controls the head elevation mechanism 98 to move up the ink-jet head 2 targeted for the capping operation and the ink-jet head 2 grouped with the targeted ink-jet head 2 from the printing position to the head maintenance position (see FIG. 6A). Then, as shown in FIG. 6B, electromagnetic coupling is caused in the clutch 84 which corresponds to the head group including the ink-jet head 2 targeted for the purge operation, so that the caps 61, 62 associated with the ink-jet head 2 targeted for the capping operation and the ink-jet head 2 grouped with the targeted ink-jet head 2 are moved from the cap withdrawal position to the capping position. Then, the maintenance unit movement controller 106 rotates the rotation motor 95 so as to rotate the gear 92 in the clockwise direction in FIG. 6B and thereby rotate the belt roller 74 in the counterclockwise direction in FIG. 6B, so that the portions of the belt 73 extending in the main scanning direction travel in the main scanning direction.

Then, the head elevation controller 104 controls the head elevation mechanism 98 to move down the ink-jet heads 2 to such a degree that the ink ejection faces 4 come into contact with the upper ends of the caps 61, 62, as shown in FIG. 5C. In this way, an enclosed space is formed between the ink ejection face 4 and the cap 61, 62, which can prevent ink existing within the nozzles 4*a* from drying up.

In the above-described ink-jet printer 1 of this embodiment, the ink ejection faces 4 of the eight ink-jet heads 2 are arranged in such a manner that the ink ejection faces 4 form two rows each including four ink ejection faces which are arranged side by side along the sub scanning direction and in addition the ink ejection faces 4 included in different rows do not overlap each other with respect to the main scanning direction. As a result, a free space appears in a region neighboring each ink-jet head 2 with respect to the main scanning direction. A plurality of wipers 63, 64 associated with the respective ink-jet heads 2 are positioned in the space. Positioning the wipers 63, 64 in the free space in this way makes it unnecessary to provide another space which is special for the wipers 63, 64 to be positioned therein. Therefore, downsizing of the ink-jet printer 1 can be realized. Further, the wipers 63, 64 can be selected and moved in units of two wipers 63, 64 associated with each head group, by the control made by the maintenance unit movement controller 106. Accordingly, it is possible that, for example, only the ink ejection faces 4 in the head group which needs a purge operation and wiping can be wiped off by the wipers 63, 64. This can prevent the ink ejection face 4 in the head group on which no purge operation is performed from being wiped by the wipers 63, 64 in vain. Therefore, deterioration of a water repellent coating formed on the ink ejection face 4 or wear-out of the wipers 63, 64 can be reduced.

Even when the belt 73 is disposed between the head groups 3*a*, 3*b*, 3*c*, 3*d*, a space formed between the head groups 3*a*, 3*b*, 3*c*, 3*d* can be made small, because the portions of the belt 73 extending in the main scanning direction are opposed to each other with respect to the vertical direction. In addition, a length of the belt can be made relatively short, which can reduce a load placed on the rotation motor which is a drive source.

In addition, a plurality of caps 61, 62 associated with each ink-jet head 2 are positioned in the free space neighboring each ink-jet head 2 with respect to the main scanning direction. This can further reduce the size of the ink-jet printer 1. Moreover, the caps 61, 62 can be selected and moved in units of two caps 61, 62 associated with each head group, by the control made by the maintenance unit movement controller 106.

In addition, when the maintenance unit 60 is disposed in the withdrawal position, the cap 61, 62 associated with an ink-jet head 2 is located at such a position that the wiper 63, 64 associated with the ink-jet head 2 is sandwiched between the cap 61, 62 and the ink-jet head 2 with respect to the main scanning direction. This can still further reduce the size of the ink-jet printer 1.

Figure 7:
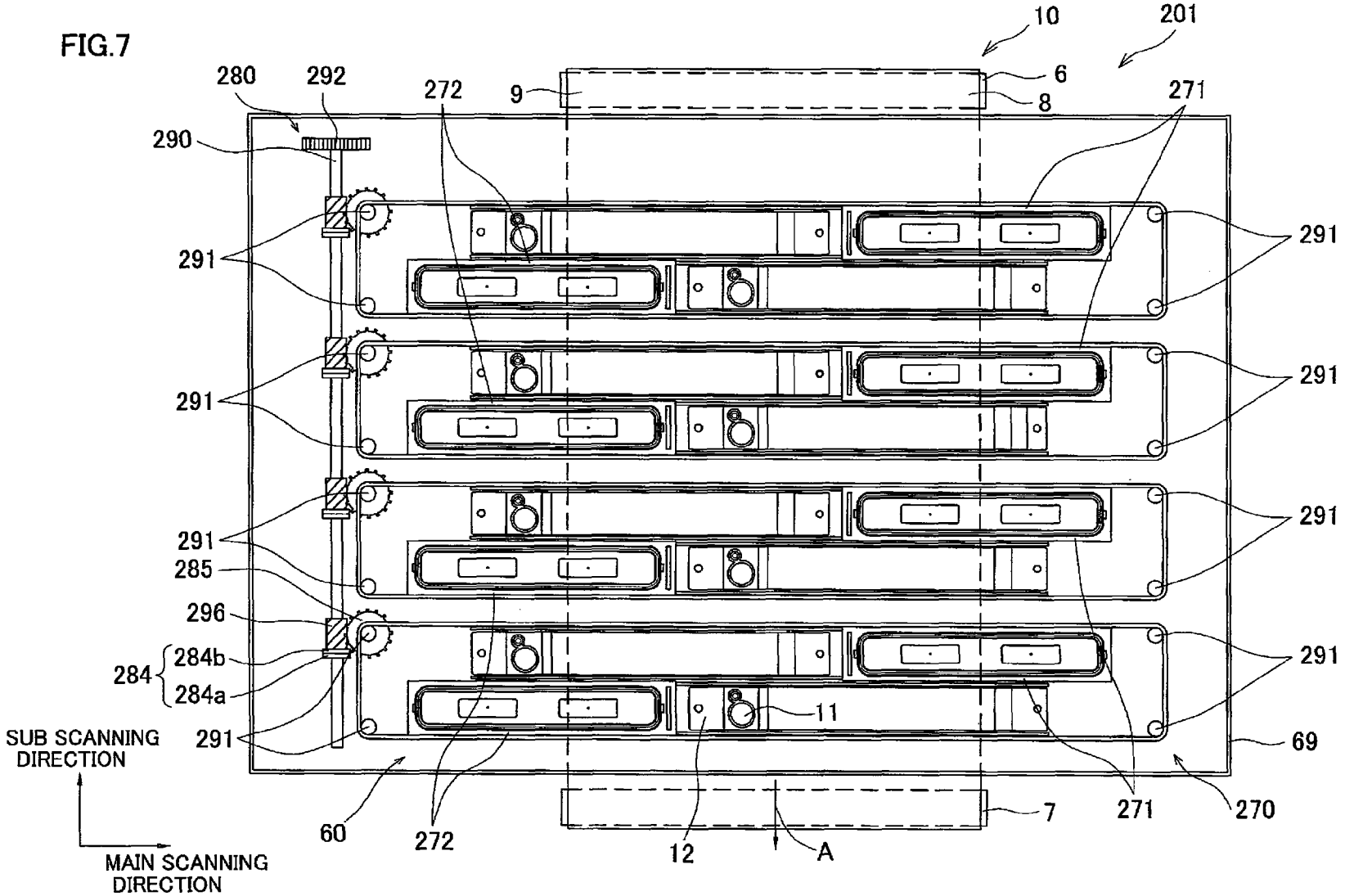
FIG. 7 is a plan view of an essential part of an ink-jet printer according to a second embodiment of the present invention.

Next, an ink-jet printer 201 according to a second embodiment of the present invention will be described below with reference to FIG. 7. FIG. 7 is a plan view of an essential part of the ink-jet printer according to the second embodiment of the present invention.

The ink-jet printer 201 of this embodiment is the same as of the first embodiment, except that a movement mechanism 270 has a difference structure from the structure of the movement mechanism 70 of the first embodiment. The same members as of the first embodiment will be denoted by the same reference signs without specific descriptions thereof.

As shown in FIG. 7, the movement mechanism 270 of this embodiment has a shaft 290, sixteen belt rollers 291, four belts 273, four support plates 271, four support plates 272, and a power transmission mechanism 280. The shaft 290 extends in the sub scanning direction and is supported rotatably about an axis thereof. The four belts 273 correspond to the respective head groups 3*a*, 3*b*, 3*c*, and 3*d*. Each of the four belts 273 is wound on four belt rollers 291 to span the four belt rollers 291. The four support plates 271 are, at one-end (upper-end in FIG. 7) portions thereof with respect to the sub scanning direction, coupled with the belts 273. Each of the four support plates 271 supports the cap 61 and the wiper 63 associated with each ink-jet head 2 included in one (right one in FIG. 7) of rows. Each of the four support plates 272 supports the cap 62 and the wiper 64 associated with each ink-jet head 2 included in the other (left one in FIG. 7) of the rows. The power transmission mechanism 280 transmits rotational power to the four belt rollers 291 corresponding to each of the head groups 3*a*, 3*b*, 3*c*, and 3*d*.

Each of the support plates 271 supports the cap 61 and the wiper 63 associated with each ink-jet head 2 included in the left row in FIG. 7. The support plate 271 is coupled with a portion of the belt 273 extending in the main scanning direction.

Each of the support plates 272 supports the cap 62 and the wiper 64 associated with each ink-jet head 2 included in the right row in FIG. 7. The support plate 272 is coupled with a portion of the belt 273 extending in the main scanning direction.

In other words, with respect to the sub scanning direction, the eight support plates 271 and 272 are arranged in a zigzag pattern inverse to the zigzag arrangement pattern of the eight ink-jet heads 2.

The sixteen belt rollers 291 are rotatably supported within the tray 69 in such a manner that, in a plan view, each of the four belts 273 encloses two ink-jet heads 2 forming a head group, and two caps 61, 62 and two wipers 63, 64 associated with the head group. As a result, spaces formed between the head groups can be made small.

The power transmission mechanism 280 has a gear 292, four gears 296, four gears 285, and four clutches 284. The gear 292 is fixed to one end (upper end in FIG. 7) of the shaft 290 so as to be rotatable with the shaft 290 about an axis of the shaft 290. The four gears 296 are fixed to the shaft 290 at positions along the sub scanning direction which correspond to the respective head groups 3*a*, 3*b*, 3*c*, and 3*d*. The four gears 296 are rotatable with the shaft 290 about the axis of the shaft 290. The four gears 285 are engaged with the four gears 296 to thereby rotate with the four gears 296. In a plan view, each of the four gears 285 is rotatably fixed to the belt roller 291 located at an upper left portion of each belt 273. The four clutches 284 transmit rotational power of the shaft 290 to the four gears 296.

The clutch 284 has an input shaft 284*a* fixed to the shaft 290, and an output shaft 284*b* fixed to the gear 296. The clutch 284 has such a structure that the input shaft 284*a* and the output shaft 284*b* are electromagnetically coupled with each other so that power is transmitted from the input shaft 284*a* to the output shaft 284*b*. Therefore, as the input shaft 284*a* rotates, the output shaft 284*b* rotates accordingly. When the input shaft 284*a* and the output shaft 284*b* are decoupled, power is no longer transmitted from the input shaft 284*a* to the output shaft 284*b*. Therefore, even when the input shaft 284*a* rotates, the output shaft 284*b* does not rotate.

As the rotation motor 95 is driven to rotate the gear 292 in a predetermined direction thereby also rotate the shaft 290 in the same direction, rotational power traveling in the same direction is transmitted to the input shafts 284*a* of the clutches 84. At this time, when the input shaft 284*a* and the output shaft 284*b* are electromagnetically coupled with each other, rotation of the input shaft 284*a* is transmitted to the output shaft 284*b*. Thereby, the output shaft 284*b* rotates, and the shaft 291 accordingly rotates in the counterclockwise direction in FIG. 7 together with the gear 285. As a result, the belt 273 travels in the counterclockwise direction. That is, the belt 273 corresponding to each of the head groups 3*a*, 3*b*, 3*c*, and 3*d* can be selectively run, by switching a state of the clutch 284 corresponding to each of the head groups 3*a*, 3*b*, 3*c*, and 3*d* between a state where the input shaft 284*a* and the output shaft 284*b* are electromagnetically coupled with each other and a state where they are not electromagnetically coupled with each other.

In the movement mechanism 270 having the above-described structure as well, when the rotation motor 95 rotates the gear 292 in the predetermined direction, the cap 61 and the wiper 63 mounted on the support plate 271 and associated with the head group for which the clutch 284 is electromagnetically coupled are moved together with the support plate 271, leftward in FIG. 7 from the withdrawal position (as shown in FIG. 7) which is not opposed to the corresponding ink ejection face 4. In addition, the cap 62 and the wiper 64 mounted on the support plate 272 and associated with the head group for which the clutch 284 is electromagnetically coupled are moved together with the support plate 272, rightward in FIG. 7 from the withdrawal position (as shown in FIG. 7) which is not opposed to the corresponding ink ejection face 4. In this way, the two caps 61, 62 and the two wipers 63, 64 associated with the head group for which the clutch 284 is electromagnetically coupled can be moved to capping positions which are opposed to the corresponding ink ejection faces 4. That is, the eight caps 61, 62 and the eight wipers 63, 64 associated with all of the four head groups 3*a*, 3*b*, 3*c*, and 3*d* can be moved to positions opposed to the respective ink ejection faces 4, by electromagnetically coupling all of the four clutches 284.

On the other hand, when the rotation motor 95 rotates the gear 92 in a direction reverse to the predetermined direction, the cap 61 and the wiper 63 mounted on the support plate 271 and associated with the head group for which the clutch 284 is electromagnetically coupled are moved rightward in FIG. 7 from the capping position opposed to the corresponding ink ejection face 4. In addition, the cap 62 and the wiper 64 mounted on the support plate 272 and associated with the head group for which the clutch 284 is electromagnetically coupled are moved leftward in FIG. 7 from the capping position opposed to the corresponding ink ejection face 4. In this way, the caps 61, 62 and the wipers 63, 64 associated with the head group for which the clutch 284 is electromagnetically coupled can be moved to the withdrawal positions which are not opposed to the corresponding ink ejection faces 4. That is, the eight caps 61, 62 and the eight wipers 63, 64 associated with all of the four head groups 3*a*, 3*b*, 3*c*, and 3*d* can be moved to the withdrawal positions not opposed to the respective ink ejection faces 4, by electromagnetically coupling all of the four clutches 284.

In the above-described ink-jet printer 201 of this embodiment, the ink ejection faces 4 of the eight ink-jet heads 2 are arranged in such a manner that the ink ejection faces 4 form two rows each including four ink ejection faces 4 which are arranged side by side along the sub scanning direction and in addition the ink ejection faces 4 included in different rows do not overlap each other with respect to the main scanning direction. As a result, a free space appears in a region neighboring each ink-jet head 2 with respect to the main scanning direction. A plurality of wipers 63, 64 associated with the respective ink-jet heads 2 are positioned in the space. Positioning the wipers 63, 64 in the free space in this way makes it unnecessary to provide another space which is special for the wipers 63, 64 to be positioned therein. Therefore, downsizing of the ink-jet printer 201 can be realized. Further, the wipers 63, 64 can be selected and moved in units of two wipers 63, 64 associated with each head group, by the control made by the maintenance unit movement controller 106. Accordingly, it is possible that, for example, only the ink ejection faces 4 in the head group which needs a purge operation and wiping can be wiped off by the wipers 63, 64. This can prevent the ink ejection face 4 in the head group on which no purge operation is performed from being wiped by the wipers 63, 64 in vain. Therefore, deterioration of a water repellent coating formed on the ink ejection face 4 or wear-out of the wipers 63, 64 can be reduced.

Figure 8:
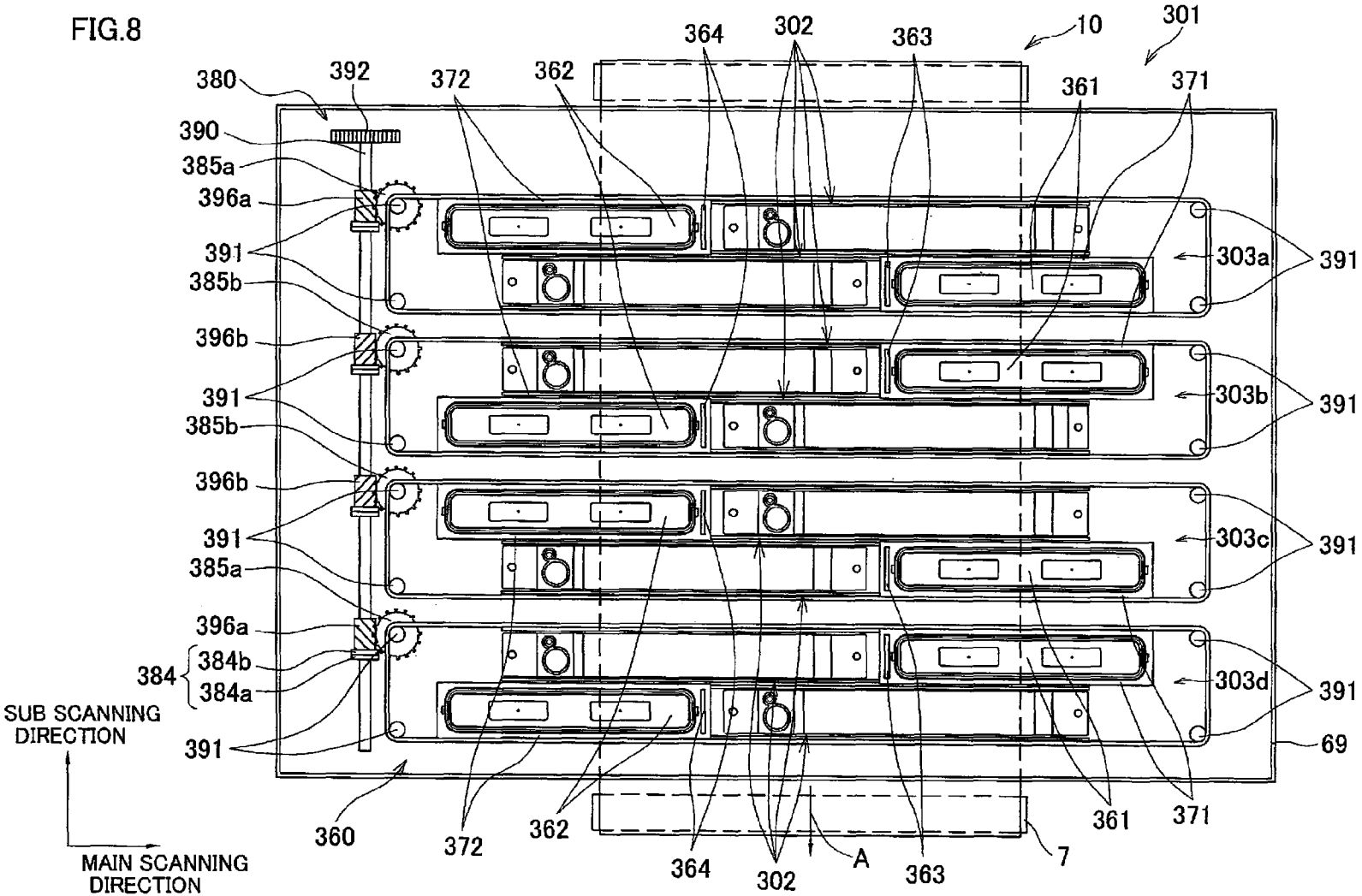
FIG. 8 is a plan view of an essential part of an ink-jet printer according to a third embodiment of the present invention.

Next, an ink-jet printer 301 according to a third embodiment of the present invention will be described below with reference to FIG. 8. FIG. 8 is a plan view of an essential part of the ink-jet printer according to the third embodiment of the present invention.

In the ink-jet printer 301 of this embodiment, neighboring ones of head groups 303*a*, 303*b*, 303*c*, and 303*d* with respect to the sub scanning direction are oriented in opposite directions, which is different from the arrangement of the head groups 3*a*, 3*b*, 3*c*, and 3*d* of the first embodiment. Accordingly, arrangement of eight caps 361, 362 and eight wipers 363, 364 is also different from the arrangement of the eight caps 61, 62 and the eight wipers 63, 64 of the first embodiment. In addition, a maintenance unit 360 of the ink-jet printer 301 has a movement mechanism 370 which is slightly different from the movement mechanism 270 of the second embodiment. Except for the above, the third embodiment is the same as the first embodiment. Structures of ink-jet heads 302, caps 361, 362, and wipers 363, 364 are the same as in the first embodiment, but only arrangements thereof are different from in the first embodiment. The same members as of the first embodiment will be denoted by the same reference signs without specific descriptions thereof.

As shown in FIG. 8, the eight ink-jet heads 302 of this embodiment are arranged in a zigzag pattern in such a manner that the ink ejection faces 4 form two rows each including four ink ejection faces 4 which are arranged side by side along the sub scanning direction and in addition the ink ejection faces 4 included in different rows do not overlap each other with respect to the main scanning direction. The eight ink-jet heads 302 are divided into four head groups 303*a*, 303*b*, 303*c*, and 303*d* each of which includes two ink-jet heads 302. Ink ejection faces 4 of the two ink-jet heads 302 neighbor each other with respect to the sub scanning direction and belong to different rows.

The four head groups 303*a*, 303*b*, 303*c*, and 303*d* are arranged side by side along the sub scanning direction. One (left one in FIG. 8) of the two ink-jet heads 302 in the head group 303*a* and one of the two ink-jet heads 302 in the head group 303*b* are located in positions which are the same with respect to the main scanning direction and adjacent to each other with respect to the sub scanning direction. The other (right one in FIG. 8) of the two ink-jet heads 302 in the head group 303*b* and the other of the two ink-jet heads 302 in the head group 303*c* are located in positions which are the same with respect to the main scanning direction and adjacent to each other with respect to the sub scanning direction. One of the two ink-jet heads 302 in the head group 303*c* and one of the two ink-jet heads 302 in the head group 303*d* are located in positions which are the same with respect to the main scanning direction and adjacent to each other with respect to the sub scanning direction.

Consequently, two caps 361, 362 and two wipers 363, 364 associated with two adjacent ink-jet heads 302 which belong to neighboring two of the head groups 303*a*, 303*b*, 303*c*, and 303*d* can be disposed at positions which are the same with respect to the main scanning direction and adjacent to each other with respect to the sub scanning direction.

The two ink-jet heads 2 belonging to each of the head groups 303*a*, 303*b*, 303*c*, and 303*d* have their ink ejection faces 4 overlap each other with respect to the sub scanning direction, which is the same structure as that of the head groups 3*a*, 3*b*, 3*c*, and 3*d* of the first embodiment.

The maintenance unit 360 has eight caps 361, 362 and eight wipers 363, 364 associated with the eight ink-jet heads 302, respectively. The maintenance unit 360 also has a movement mechanism 370 which moves the caps 361, 362 and the wipers 363, 364 in the main scanning direction.

The movement mechanism 370 has a shaft 390, sixteen belt rollers 391, four belts 373, four support plates 371, four support plates 372, and a power transmission mechanism 380. The shaft 390 extends in the sub scanning direction and is supported rotatably about an axis thereof. The four belts 373 correspond to the respective head groups 303*a*, 303*b*, 303*c*, and 303*d*. Each of the four belts 373 is wound on four belt rollers 391 to span the four belt rollers 391. The four support plates 371 are, at one-end (upper-end in FIG. 8) portions thereof with respect to the sub scanning direction, coupled with the belts 373. Each of the four support plates 371 supports the cap 361 and the wiper 363 associated with each ink-jet head 302 included in one (right one in FIG. 8) of rows. Each of the four support plates 372 supports the cap 362 and the wiper 364 associated with each ink-jet head 302 included in the other (left one in FIG. 8) of the rows. The power transmission mechanism 380 transmits rotational power to one belt roller 391 corresponding to each of the head groups 303*a*, 303*b*, 303*c*, and 303*d*.

Each of the support plates 371 supports the cap 361 and the wiper 363 associated with each ink-jet head 302 included in the left row in FIG. 8. The support plate 371 is coupled with a portion of the belt 373 extending in the main scanning direction.

Each of the support plates 372 supports the cap 362 and the wiper 364 associated with each ink-jet head 302 included in the right row in FIG. 8. The support plate 372 is coupled with a portion of the belt 373 extending in the main scanning direction.

The sixteen belt rollers 391 are rotatably supported within the tray 69 in such a manner that, in a plan view, each of the four belts 373 encloses two ink-jet heads 302 forming a head group, and two caps 361, 362 and two wipers 363, 364 associated with the head group. As a result, spaces formed between the head groups can be made small.

The power transmission mechanism 380 has a gear 392, two gears 396*a*, two gears 396*b*, four gears 385*a*, 385*b*, and clutches 384. The gear 392 is fixed to one end (upper end in FIG. 8) of the shaft 390 so as to be rotatable with the shaft 390 about an axis of the shaft 390. The two gears 396*a* are supported at positions along the sub scanning direction which correspond to the respective head groups 303*a* and 303*d*. The two gears 396*a* are rotatable with the shaft 390 about the axis of the shaft 390. The two gears 396*b* are supported at positions along the sub scanning direction which correspond to the respective head groups 303*b* and 303*c*. The two gears 396*b* are rotatable with the shaft 390 about the axis of the shaft 390. The four gears 385*a* and 385*b* are engaged with the four gears 396*a* and 396*b* to thereby rotate with the gears 396*a* and 396*b*. In a plan view, each of four gears 385*a* and 385*b* is rotatably fixed to the belt roller 391 located at an upper left portion of each belt 373. The four clutches 384 transmit rotational power of the shaft 390 to the four gears 396*a* and 396*b*.

The gear 396*a* rotates in a predetermined direction to thereby rotate the gear 385*a* in the clockwise direction in FIG. 8. The gear 396*b*, whose threaded direction is reversed to that of the gear 396*a*, rotates in a predetermined direction to thereby rotate the gear 385*b* in the counterclockwise direction in FIG. 8.

The clutch 384 has an input shaft 384*a* fixed to the shaft 390, and an output shaft 384*b* fixed to the gear 396*a*, 396*b*. The clutch 384 has such a structure that the input shaft 384*a* and the output shaft 384*b* are electromagnetically coupled with each other so that power is transmitted from the input shaft 384*a* to the output shaft 384*b*. Therefore, as the input shaft 384*a* rotates, the output shaft 384*b* rotates accordingly. When the input shaft 384*a* and the output shaft 384*b* are decoupled, power is no longer transmitted from the input shaft 384*a* to the output shaft 384*b*. Therefore, even when the input shaft 384*a* rotates, the output shaft 384*b* does not rotate.

As the rotation motor 95 is driven to rotate the gear 392 in a predetermined direction thereby also rotate the shaft 390 in the same direction, rotational power traveling in the same direction is transmitted to the input shafts 384*a* of the clutches 384. At this time, when the input shaft 384*a* and the output shaft 384*b* are electromagnetically coupled with each other, rotation of the input shaft 384*a* is transmitted to the output shaft 384*b* which therefore rotates. As the output shaft 384*b* rotates, the gear 396*a* rotates accordingly. Thus, the gear 385*a* engaged with the gear 396*a*, and the shaft 391 fixing the gear 385*a* rotate together in the clockwise direction in FIG. 8. As a result, the belt 373 travels in the clockwise direction. Moreover, as the output shaft 384*b* rotates, the gear 396*b* rotates accordingly. Thus, the gear 385*b* engaged with the gear 396*b*, and the shaft 391 fixing the gear 385*b* rotate together in the counterclockwise direction in FIG. 8. As a result, the belt 373 travels in the counterclockwise direction. That is, each belt 373 can be selectively run, by switching a state of the clutch 384 corresponding to each of the head groups 303*a*, 303*b*, 303*c*, and 303*d* between a state where the input shaft 384*a* and the output shaft 384*b* are electromagnetically coupled with each other and a state where they are not electromagnetically coupled with each other.

In the movement mechanism 370 having the above-described structure as well, when the rotation motor 95 rotates the gear 392 in the predetermined direction, the cap 361 and the wiper 363 mounted on the support plate 371 and associated with the head group for which the clutch 384 is electromagnetically coupled are moved together with the support plate 371, leftward in FIG. 8 from the withdrawal position (as shown in FIG. 8) which is not opposed to the corresponding ink ejection face 4. In addition, the cap 362 and the wiper 364 mounted on the support plate 372 and associated with the head group for which the clutch 384 is electromagnetically coupled are moved together with the support plate 372, rightward in FIG. 8 from the withdrawal position which is not opposed to the corresponding ink ejection face 4. In this way, the two caps 361, 362 and the two wipers 363, 364 associated with the head group for which the clutch 384 is electromagnetically coupled can be moved to capping positions which are opposed to the corresponding ink ejection faces 4. That is, the eight caps 361, 362 and the eight wipers 363, 364 associated with all of the four head groups 303*a*, 303*b*, 303*c*, and 303*d* can be moved to positions opposed to the respective ink ejection faces 4, by electromagnetically coupling all of the four clutches 384.

On the other hand, when the rotation motor 95 rotates the gear 392 in a direction reverse to the predetermined direction, the cap 361 and the wiper 363 mounted on the support plate 371 and associated with the head group for which the clutch 384 is electromagnetically coupled are moved rightward in FIG. 8 from the capping position opposed to the corresponding ink ejection face 4. In addition, the cap 362 and the wiper 364 mounted on the support plate 372 and associated with the head group for which the clutch 384 is electromagnetically coupled are moved leftward in FIG. 7 from the capping position opposed to the corresponding ink ejection face 4. In this way, the caps 361, 362 and the wipers 363, 364 associated with the head group for which the clutch 384 is electromagnetically coupled can be moved to the withdrawal positions which are not opposed to the corresponding ink ejection faces 4. That is, the eight caps 361, 362 and the eight wipers 363, 364 associated with all of the four head groups 303*a*, 303*b*, 303*c*, and 303*d* can be moved to the withdrawal positions not opposed to the respective ink ejection faces 4, by electromagnetically coupling all of the four clutches 384.

In the above-described ink-jet printer 301 of this embodiment, the ink ejection faces 4 of the eight ink-jet heads 302 are arranged in such a manner that the ink ejection faces 4 form two rows each including four ink ejection faces 4 which are arranged side by side along the sub scanning direction and in addition the ink ejection faces 4 included in different rows do not overlap each other with respect to the main scanning direction. As a result, a free space appears in a region neighboring each ink-jet head 302 with respect to the main scanning direction. A plurality of wipers 363, 364 corresponding to the respective ink-jet heads 302 are positioned in the space. Positioning the wipers 363, 364 in the free space in this way makes it unnecessary to provide another space which is special for the wipers 363, 364 to be positioned therein. Therefore, downsizing of the ink-jet printer 301 can be realized. Further, the wipers 363, 364 can be selected and moved in units of two wipers 363, 364 associated with each head group, by the control made by the maintenance unit movement controller 106. Accordingly, it is possible that, for example, only the ink ejection faces 4 in the head group which needs a purge operation and wiping can be wiped off by the wipers 363, 364. This can prevent the ink ejection face 4 in the head group on which no purge operation is performed from being wiped by the wipers 363, 364 in vain. Therefore, deterioration of a water repellent coating formed on the ink ejection face 4 or wear-out of the wipers 363, 364 can be reduced.

In the above-described embodiments, two ink-jet heads which eject ink of the same color are arranged so as to allow printing to be made continuously without a break in the main scanning direction when these two ink-jet heads eject ink to form an image. However, it may be possible that the two ink-jet heads do not overlap each other with respect to the sub scanning direction so as to allow non-continuous printing having a break in the main scanning direction when an image is formed. The ink-jet printers according to the embodiments may not include the caps.

In the above-described embodiments, by rotational drive of a single rotation motor, the belt is run to selectively move the caps and wipers. However, different rotation motors may be provided for the respective belts. In such a case, by controlling the rotation motors, the belt can be selectively run to selectively move the caps and wipers on a head group basis. That is, a rotation motor may be provided for every head group, as a switching means. At this time, it is not necessary to provide the clutch.

Further, the above-described embodiments are examples of application of the present invention to an ink-jet printer including a plurality of ink-jet heads which eject ink from nozzles. However, such an ink-jet head is not the only thing to which the present invention is applicable. For example, the present invention may be applied to various image recording apparatus including a plurality of liquid ejection heads for ejecting a conductive paste to form a fine wiring pattern on a substrate, for ejecting an organic luminescent material to a substrate to form a high-resolution display, and for ejecting optical plastics to a substrate to form a very small electronic device such as an optical waveguide.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An image recording apparatus comprising:

a plurality of liquid ejection heads respectively having ejection faces which are arranged in such a manner that the ejection faces form two rows extending in one direction and in addition two of the ejection faces included in different rows do not overlap each other along a direction perpendicular to the one direction with respect to an in-plane direction of the ejection faces, the plurality of liquid ejection heads being divided into a plurality of head groups each including two of the liquid ejection heads corresponding to the different rows;

a recording medium conveyance mechanism which conveys a recording medium in the one direction while making the recording medium opposed to the ejection faces;

a plurality of wipers which wipe the ejection faces of the liquid ejection heads; and a movement mechanism which moves two of the wipers for wiping two ejection faces of the two liquid ejection heads belonging to each head group, in opposite directions with respect to the perpendicular direction while keeping the two wipers in contact with the ejection faces, wherein, when in a wiper withdrawal position not opposed to the ejection face, the wiper associated with one of the liquid ejection heads belonging to each head group is positioned so as to overlap the one liquid ejection head along the perpendicular direction and in addition overlap the other of the liquid ejection heads along the one direction, while, when in the wiper withdrawal position, the wiper associated with the other liquid ejection head is positioned so as to overlap the other liquid ejection head along the perpendicular direction and in addition overlap the one liquid ejection head along the one direction.

2. The image recording apparatus according to claim 1, wherein:

each of the plurality of head groups is made up of two of the liquid ejection heads which eject liquid of the same color;

the movement mechanism selectively moves the plurality of wipers in units of the two wipers associated with the head group; and the image recording apparatus further comprises a movement control unit which controls the movement mechanism in such a manner that the two wipers associated with, among the plurality of head groups, the selected head group wipe two ejection faces in the head group.

3. The image recording apparatus according to claim 2, wherein:

the movement mechanism includes a plurality of belts each of which is coupled with the two wipers associated with the head group and travels along the perpendicular direction to thereby move the two wipers in the opposite directions, and a plurality of switching units each of which can be switched between a state of transmitting power from a drive source to the belt and a state of not transmitting power from the drive source to the belt; and the movement control unit switches at least one of the switching means into the state of transmitting power from the drive source to the belt.

4. The image recording apparatus according to claim 3, wherein the movement control unit switches all the switching units into the state of transmitting power from the drive source to the belt.

5. The image recording apparatus according to claim 3, wherein each of the plurality of belts is disposed so as to, in a plan view, enclose the two liquid ejection heads belonging to the head group and the two wipers associated with the head group.

6. The image recording apparatus according to claim 3, wherein each of the plurality of belts is disposed between the two liquid ejection heads belonging to the head group, in such a manner that portions of the belt extending in the perpendicular direction are opposed to each other with respect to a vertical direction.

7. The image recording apparatus according to claim 3, further comprising a plurality of caps which cover the ejection faces by being in contact with the ejection faces, wherein each belt is coupled with two of the caps which are associated with the two liquid ejection heads belonging to the head group, and travels along the perpendicular direction so that the two caps move in the opposite directions along the perpendicular direction between a capping position opposed to the ejection face and a cap withdrawal position not opposed to the ejection face.

8. The image recording apparatus according to claim 7, wherein, when in the cap withdrawal position, the cap associated with the one liquid ejection head is positioned so as to overlap the one liquid ejection head along the perpendicular direction and in addition overlap the other liquid ejection head along the one direction, while, when in the cap withdrawal position, the cap associated with the other liquid ejection head is positioned so as to overlap the other liquid ejection head along the perpendicular direction and in addition overlap the one liquid ejection head along the one direction.

9. The image recording apparatus according to claim 8, wherein, when the wiper is disposed in the wiper withdrawal position, the cap associated with the liquid ejection head is located in such a position that the wiper associated with the liquid ejection head is sandwiched between the cap and the liquid ejection head with respect to the perpendicular direction.

* * * * *